US009841028B2

(12) United States Patent
Knedler et al.

(10) Patent No.: US 9,841,028 B2
(45) Date of Patent: Dec. 12, 2017

(54) PUMP CONTROL HAVING REPOSITIONABLE DISPLAY

(75) Inventors: Jan Knedler, Rastatt (DE); Klaus Müller, Karlsruhe (DE); Karsten Antonius, Pfinztal (DE); Matthias Ulmer, Bammental (DE); Mohammad Mehdi Ayatollahzadeh, Karlsruhe (DE)

(73) Assignee: Grundfos Management a/s, Bjerringbro (DK)

( * ) Notice: Subject to any disclaimer, the term of this patent is extended or adjusted under 35 U.S.C. 154(b) by 449 days.

(21) Appl. No.: 13/522,799

(22) PCT Filed: Jan. 17, 2011

(86) PCT No.: PCT/EP2011/000162
§ 371 (c)(1),
(2), (4) Date: Aug. 17, 2012

(87) PCT Pub. No.: WO2011/088976
PCT Pub. Date: Jul. 28, 2011

(65) Prior Publication Data

US 2012/0308401 A1 Dec. 6, 2012

(30) Foreign Application Priority Data

Jan. 19, 2010 (EP) ..... 10000462

(51) Int. Cl.
*F04D 15/00* (2006.01)
*F04D 13/06* (2006.01)
(Continued)

(52) U.S. Cl.
CPC ..... *F04D 15/0088* (2013.01); *F04B 39/121* (2013.01); *F04B 39/14* (2013.01);
(Continued)

(58) Field of Classification Search
CPC ..... F04D 13/06; F04D 15/00; F04D 15/0088; F04D 25/0606; F04D 25/0666;
(Continued)

(56) References Cited

U.S. PATENT DOCUMENTS 2,161,365 A * 6/1939 Martin ..... B23F 23/12 409/34
4,918,930 A * 4/1990 Gaudet et al. ..... 62/55.5
(Continued)

FOREIGN PATENT DOCUMENTS

DE 33 42 967 A1 6/1985
DE 689 12 009 T2 6/1994
(Continued)

OTHER PUBLICATIONS

Machine Transtation of EP 1 429 034, Patent Translate, EPO Aug. 31, 2016, pp. 1-5.*
Japanese Office Action dated Sep. 2, 2014.

*Primary Examiner* — Bryan Lettman
*Assistant Examiner* — Timothy Solak
(74) *Attorney, Agent, or Firm* — McGlew and Tuttle, P.C.

(57) ABSTRACT

A pump unit includes a drive motor (14) and a first housing (2), in which a control electronics unit (18) is arranged for operating the drive motor (14). An operating unit (20) having at least one display or operating element (26, 28, 30) can be detachably connected to the first housing in at least two different positions.

15 Claims, 4 Drawing Sheets

(51) Int. Cl.

| | |
|---|---|
| ***F04D 25/06*** | (2006.01) |
| ***F04D 29/40*** | (2006.01) |
| ***F04B 49/06*** | (2006.01) |
| ***F04B 39/14*** | (2006.01) |
| ***F04B 39/12*** | (2006.01) |
| ***F04B 53/16*** | (2006.01) |

(52) U.S. Cl.
CPC ..... *F04B 49/06* (2013.01); *F04B 53/16* (2013.01); *F04D 13/06* (2013.01); *F04D 25/06* (2013.01); *F04D 29/40* (2013.01)

(58) Field of Classification Search
CPC ..... F04D 29/00; F04D 29/002; F04D 29/007; F04D 29/40; F04D 29/406; F04D 29/42; F04D 29/60; F04D 29/601; F04D 29/605; F04D 29/62; F04B 39/12; F04B 39/121; F04B 39/14; F04B 49/06; F04B 49/065; F04B 53/22; F04B 53/16
USPC ..... 417/63, 238, 321, 423.15, 572
See application file for complete search history.

(56) References Cited

U.S. PATENT DOCUMENTS

| | | | | |
|---|---|---|---|---|
| 6,439,856 | B1 * | 8/2002 | Ivey | F04B 49/00 417/63 |
| 6,655,925 | B1 * | 12/2003 | Robenalt et al. | 417/234 |
| 6,678,747 | B2 | 1/2004 | Goossen et al. | |
| 7,458,784 | B2 * | 12/2008 | Vos | B25H 3/00 137/343 |
| 2006/0129088 | A1 * | 6/2006 | Gill | F04B 49/00 604/67 |
| 2008/0159729 | A1 * | 7/2008 | Hong | G03B 3/10 396/133 |
| 2009/0056123 | A1 * | 3/2009 | Phillips et al. | 29/888 |
| 2009/0125252 | A1 * | 5/2009 | Silovic et al. | 702/47 |
| 2009/0226309 | A1 * | 9/2009 | Reuter | F04D 25/06 415/182.1 |
| 2010/0119379 | A1 * | 5/2010 | Becker | F04B 45/00 417/48 |

FOREIGN PATENT DOCUMENTS

| | | | | | |
|---|---|---|---|---|---|
| DE | 201 07 726 | U1 | | 8/2001 | |
| DE | 101 31 150 | A1 | | 1/2003 | |
| DE | 10257493 | A1 | | 9/2004 | |
| DE | 10 2005 060175 | A1 | | 6/2007 | |
| EP | 0 533 935 | | * | 8/1993 | F04B 37/08 |
| EP | 0 553 935 | | * | 8/1993 | F04B 37/08 |
| EP | 0 553 935 | A1 | | 8/1993 | |
| EP | 07 26 699 | A1 | | 8/1996 | |
| EP | 1 204 194 | A1 | | 5/2002 | |
| EP | 1 429 034 | | * | 6/2004 | F04D 29/58 |
| EP | 1 429 034 | A2 | | 6/2004 | |
| JP | S56-014296 | U | | 2/1981 | |
| JP | H05-057371 | U | | 7/1993 | |
| JP | 2002-223574 | A | | 8/2002 | |
| JP | 2010-024931 | A | | 2/2010 | |

* cited by examiner

PUMP CONTROL HAVING REPOSITIONABLE DISPLAY

CROSS REFERENCE TO RELATED APPLICATIONS

This application is a United States National Phase application of International Application PCT/EP2011/000162 dated Jan. 17, 2011, and claims the benefit of priority under 35 U.S.C. §119 of filed European Patent Application EP 10 000 462.1 dated Jan. 19, 2010, the entire contents of which are incorporated herein by reference.

FIELD OF THE INVENTION

The invention relates to a pump assembly with a drive motor and with a first housing, in which control electronics for the operation of the drive motor are arranged.

BACKGROUND OF THE INVENTION

Pump assemblies, for example metering pump assemblies or centrifugal pump assemblies are known and are formed of essentially two parts, specifically of a stator housing or drive housing and of a pump unit which is connected to this drive housing. Modern pumps thereby in the drive usually comprise control and regulation electronics for activating an electrical drive motor and suitable display elements and operating elements on the outer side of the drive housing. The problem is that the display elements and operating elements on an outer side of the drive housing are possibly poorly accessible or poorly visible depending on the set-up location and/or installation position of the pump assembly.

SUMMARY OF THE INVENTION

It is therefore the object of the invention, to improve a pump assembly to the extent that operating elements and/or display elements on the pump assembly are well accessible and visible even at different installation locations and/or different installation positions of the pump assembly.

The pump assembly according to the invention comprises a drive motor which drives a pump, for example a displacement pump or centrifugal pump. Moreover, the pump assembly comprises a first housing, in which control electronics are arranged. With regard to these control electronics it is the case of electronic components which serve for the regulation (closed-loop control) and/or control of the electric drive motor. Thereby, it can be the case of electronic components which set or regulate the speed of the drive motor according to values set externally or on the basis of values detected in the pump assembly itself. In particular, the control electronics can for example also comprise a frequency converter for the speed control of the drive motor. It can also be the case of electronics for activating stepper motor, which for example is applied in metering pump assemblies. Settings for the regulation or the control of the drive motor can for example be transmitted by external automation systems via suitable interfaces to the control electronics or however be made by way of manual inputs via an operating unit. Simultaneously, the control device can preferably display certain operating conditions, fault notices or other parameters by way of a display device on the pump assembly.

For this, according to the invention, an operating unit is provided with at least one display element or operating element. According to the invention, this operating unit is not integrated in a fixed manner into the first housing, in which the control electronics are arranged. Rather, the operating unit is designed as a separate component which is connectable to the first housing, preferably in a releasable manner. Thereby, the first housing and the operating unit are designed such that the operating unit is releasably connectable to the first housing in at least two different positions. Further preferably, the operating unit can be connected to the first housing in more than two, for example three or four different positions. The possibility of attaching the operating unit on the first housing in different positions has the advantage that depending on the set-up location or installed position of the pump assembly, the operating unit can be arranged on the first housing such that it is well accessible and visible from the outside. Thus the positioning or arrangement of the operating unit can be very simply changed depending on the installation position or the set-up location, without for example having to make available different pump assemblies for different installation position or locations.

Instead of designing the operating unit such that it is attachable on the first housing in several positions, it is also possible to design the operating unit such that it is selectively either attachable on the first housing or can be arranged externally to the first housing. According to this embodiment, thus the operating unit can be arranged distanced further from the first housing. For this, the operating unit can for example be set up separately from the first housing, or be fastened on a support, for example on a wall. I.e. with this arrangement, the operating unit can be arranged without a fixed mechanical connection to the first housing. Alternatively, it can be attached directly on the first housing. Thereby, it is also conceivable for the operating unit, as described above, to alternatively be connectable to the first housing in several different positions.

If the operating unit is connected to the first housing, this connection is further preferably effected such that the connection is releasable from the outside. This allows the operating unit to be released from the first housing and to be able to be arranged in one of the alternative fastening positions, be it on the first housing or in an externally distanced manner, even after the assembly of the pump assembly. Thus on setting up the pump assembly, it is easily possible to change the attachment position of the operating unit.

The operating unit is preferably signal-connected to the control electronics in the first housing. This connection can be effected via optical and/or electrical leads or also in a wireless manner, for example inductively or per radio transmission. Contact elements can also be arranged between the operating unit and the first housing, and come into conductive contact with one another when the operating unit is connected to the first housing in one of the envisaged assembly positions. Preferably, the signal-connection is designed such that one and the same signal connection can be used in different attachment positions of the operating unit. Thus for example a connection can also be ensured in different attachment positions of the operating unit for example by way of a cable connection due to the movability of the cable. In the case that contacts, for example plug contacts are provided, it is also conceivable to arrange several contact banks, wherein corresponding connection contacts of the operating unit always come into contact with only one of these contact banks, depending on the attachment position.

The operating unit is preferably releasably connectable to the first housing with a non-positive or positive fit. Thus the operating unit for example can be connected to the housing by way of a locking connection. Alternatively or additionally, for example a fastening by way of screw connections is possible. A magnetic or other suitable releasable fixation is conceivable. Preferably, the fastening of the operating unit on the first housing is however designed such that it cannot be too easily released, in order to prevent an unintended release. Thus for example a screw connection is preferred, since in this manner a fixed but releasable connection is achieved. Usually, the operating unit before or on assembly of the pump assembly is fastened once on the first housing in the desired position and then remains in this position, unless the pump assembly is to be used later in a different installed position or at another place of installation.

Further preferably, the operating unit is connectable to the first housing in at least two positions which are different in that the at least one display element or operating element is directed in different spatial directions which are preferably at right angles to one another. Thus the operating unit can be selectively attached on the first housing such that the operating elements and display elements can be operated and seen from different sides or directions.

Preferably, the operating unit is designed such that it is arranged on sides of the first housing which are directed in at least two different directions, and is connectable to the first housing in these positions. The two sides of the housing can be side surfaces or side walls of the first housing which are arranged at an angle to one another, or however different peripheral sections of a curved or round housing, so that the sections of the side walls are directed in different spatial directions, i.e. are away from one another. The operating unit can preferably be connected to the first housing in at least two different positions such that the operating unit can either be positioned on the first or the second side or as the case may be, on further sides and thus can likewise be attached on the first housing in a manner aligned in different directions.

According to a further preferred embodiment, the first housing of polyhedral, preferably essentially cuboid, and the operating unit is connectable to the first housing in a positioned manner on at least two, preferably three different side walls.

Thus the operating unit can for example be applied on two or three different side walls onto the first housing which forms a base body. For example, with a cuboid housing, this can be two opposite side walls and the side wall which lies therebetween and which connects these, so that the operating unit is connectable to the first housing in three different angular positions, specifically 0°, 90° and 180°. For example, the cuboid housing can thus carry the operating unit on one of its two side surfaces or on an end-face situated between these side surfaces.

Usefully, the first housing comprises a first wall, through which the signal connection to the operating unit is led, and the operating unit comprises two contact surfaces, of which the first comes to bear on the first wall of the first housing, and the second contact surface selectively comes to bear on at least two walls of the first housing which are adjacent the first wall. This design has the advantage that the signal connection between the operating unit and the control and regulation electronics can be created in the inside of the first housing, in the region of the first wall to a first contact surface of the operating unit. In this manner, it is possible for the signal connection to be independent of the positioning of the operating unit on the first housing. For example, an electric connection cable can be led between the control electronics and the operating unit through the first wall into an adjacent first contact surface of the operating unit. This operating unit is merely applied onto the housing in different angular positions for a different positioning, and the first wall however always remains in bearing contact with the first contact surface of the operating unit, so that the connection cable merely needs to be rotated about a certain angle, in order to be able to apply the operating unit onto the first housing in a differently positioned manner. Preferably, with regard to the first wall, it is the case of the upper side of a cuboid housing, and the operating unit can be applied with its second contact surface onto three sides walls which are adjacent this upper side or onto two opposite side walls and the end-wall of the cuboid first housing which lies therebetween. Thereby, the first contact surface of the operating unit always lies above the first wall, preferably the upper side of the cuboid housing.

Contact or bearing contact in the context of the previous description is not only to be understood as a direct, surfaced bearing contact between the contact surface and wall, but rather, as the case may be, a regional or pointwise contact or also an indirect contact via spacer elements. Thus for example, the wall of the first housing can be designed in a structured, for example ribbed manner and the contact surface of the operating unit merely comes to bear on the upper sides of the ribs. Also spacer elements, in particular in the form of insulation elements for thermal insulation can be arranged between the walls of the first housing and the contact surfaces of the operating unit, so that free spaces or air gaps remain at least in part regions between the contact surfaces and the walls of the first housing which face these. Such an arrangement can be preferred, in order to avoid the formation of condensation water or to improve the discharge of condensation water between the first housing and the operating unit. A thermal decoupling can also be preferred, if for example components producing waste heat, for example power electronics, are present in the first housing. Thus in particular, operating elements can be thermally decoupled from the first housing, so that there is no danger of getting burnt when touching the operating elements. Further thermally sensitive components can also be relocated into the operating unit, in order to thermally decouple these from components in the first housing which produce heat. Moreover, by way of an arrangement with which the operating unit is arranged distanced at least to a part of a wall of the first housing which is covered by the operating unit, there is the possibility of air for cooling the components being able to circulate between the operating unit and the first housing in an unhindered manner.

The two contact surfaces of the operating unit which come to bear on or partly overlap with two walls of the first housing which are adjacent one another, preferably extend angled to one another, further preferably at an angle of 90°. Thus in the case of a polyhedral, in particular cuboid housing, it is possible for the operating unit to engage around the edge between two walls of the first housing, so that the contact surfaces of the operating unit at least partly overlap two walls of the first housing which are adjacent to one another, or come to bear on these walls.

The at least one display element or operating element is further preferably arranged on a front surface of the operating unit which extends in an angled manner to one, preferably to both contact surfaces. Thus an oblique arrangement of the display elements and operating elements can be selected such that the front surface is well visible and preferably frontally visible, so that a simpler operation and readability are given. Preferably, the front surface is angled at an angle between 5° and 80°, further preferably at an angle between 10° and 60° and in particular an angle between 15° and 30° to at least one of the contact surfaces. For example, the front surface can be angled at an angle of 45°, so that in the case of a cuboid housing, it extends preferably normally to an angle bisector between two walls of the housing which are adjacent one another. If the front surface is thus arranged for example obliquely above the upper edge of a cuboid housing, wherein a first contact surface of the operating unit lies over the upper side of the cuboid housing, and the second contact surface of the operating unit bears on a side wall of the cuboid housing, then the front plate with the operating elements and/or display elements is optimally visible obliquely from above.

According to a further preferred embodiment, a preferably circular opening is formed in the first wall of the housing, through which opening signal leads or cables are led to the operating unit. The operating unit can be rotatable about this circular opening. Thus in particular a corresponding circular opening can be arranged in the operating unit congruently to the opening in the first wall of the first housing, so that these openings come to lie over one another when the operating unit is applied onto the first housing. Moreover, a seal can be provided between the opening in the operating unit and an opening in the first housing, in order to be able to prevent a penetration of moisture into the inside of the first housing and/or into the operating unit at this interface. A round or circular design of the openings thereby permits the application of an O-ring as a seal, which permits a simple sealing. Moreover, with a circular design of the openings, these can be brought to completely overlap even at different angular positions of the operating unit about the longitudinal axis of the openings. Thus a simple sealing with one and the same seal can be achieved even with different angular positions, at which the operating unit is positionable on the first housing.

Particularly preferably, the middle point or the rotation axis or symmetry axis of the opening in the first wall is distanced equally to the edges of at least two walls which are adjacent this first wall and on which the operating unit is positionable. Thus the circular opening in the first housing can for example be arranged on the upper side of cuboid housing such that the middle point of the opening is distanced equally far from the edges to two or three adjacent side walls of the first housing. Thus the operating unit can then be applied from above onto the first housing in two or three angular positions which are rotated by 90° to one another, wherein a first contact surface of the operating unit and in particular an opening formed in the operating unit always comes to bear on the central opening on the upper side or the first wall of the first housing in a congruent manner. A second contact surface of the operating unit then selectively comes to bear or to overlap on one of several side walls of the housing which are adjacent the first wall. Thereby, the operating unit then engages around the edge between the first wall and an adjacent side wall of the housing.

According to a preferred embodiment of the invention, the first housing is a motor housing, in which the drive motor is arranged, or a terminal box. The drive motor as well as the control electronics can be arranged in a motor housing. Thus for example with a metering pump assembly, the drive motor, as the case may be gear and control electronics can be arranged in a motor housing, onto which then preferably a pump head is applied at one side. The pump head is thereby preferably applied on an end-side, and the operating unit is designed such that it can be selectively applied on the opposite end-side or one of the side surfaces of a cuboid motor housing which connect the two end-sides, wherein preferably a first contact surface of the operating unit always comes to bear on the upper side of the first housing which is adjacent the two side walls and the two end-sides. In the case of other, in particular polyhedral housing shapes however, selectively other positions of the operating unit on the housing are also conceivable.

With other pump assemblies it is possible for the control electronics and the drive motor not to be arranged in one and the same housing. Thus for example, the control electronics can be arranged in a separate housing, in particular a terminal box which then in turn for example is connected to a stator housing or motor housing. It is possible in this case, for the operating unit to be positionable and fastenable on the terminal box selectively at least two different positions or in two different attitudes. With regard to the terminal box, in particular it is thereby the case of that component, in which the electrical connection leads of the pump assembly are electrically connected. As described, with regard to the pump assembly it is preferably the case of a metering pump assembly, however for example also a centrifugal pump assembly or another pump assembly. If with regard to the pump assembly according to the invention it is the case of a centrifugal pump assembly, then it can further preferably be the case of a wet-running centrifugal pump assembly, i.e. a pump assembly with a wet-running electrical drive motor. Such a pump assembly can for example be a heating circulation pump assembly. This however does not exclude the invention being able to be applied also to dry-running heating circulation pump assemblies.

Particularly preferably, the first housing is a motor housing, in which the drive motor is arranged and which is connected at one side to a pump, wherein the operating unit is selectively positionable on two, preferably on three sides of the motor housing which are away from the pump. Thus depending on the installation position of the pump, the operating unit can be positioned on the motor housing such that it is well accessible and readable. The operating unit preferably comprises display elements in the form of signal lamps or a display and moreover operating units, for example keys, switches, push buttons and/or rotating operating elements, for example also a rotate-push button or dial, which are used for setting functions and operating modes and other parameters of the pump assembly via the control electronics. Thereby, the operating unit can yet contain further electronic components for data transmission, signal processing and/or signal transmission or likewise. What is important is that the control electronics are not or not completely integrated into the operating unit. At least part, in particular a significant part of the control electronics are arranged in the first housing, preferably a motor housing or terminal box which is independent of the operating unit. This permits the operating unit to be designed as a relatively small and light component and to limit the lead connections between the operating unit and the control electronics to pure signal leads. In particular, no power-electronic components which lead to the mains voltage need to be arranged in the operating unit, by which means the safety is improved.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
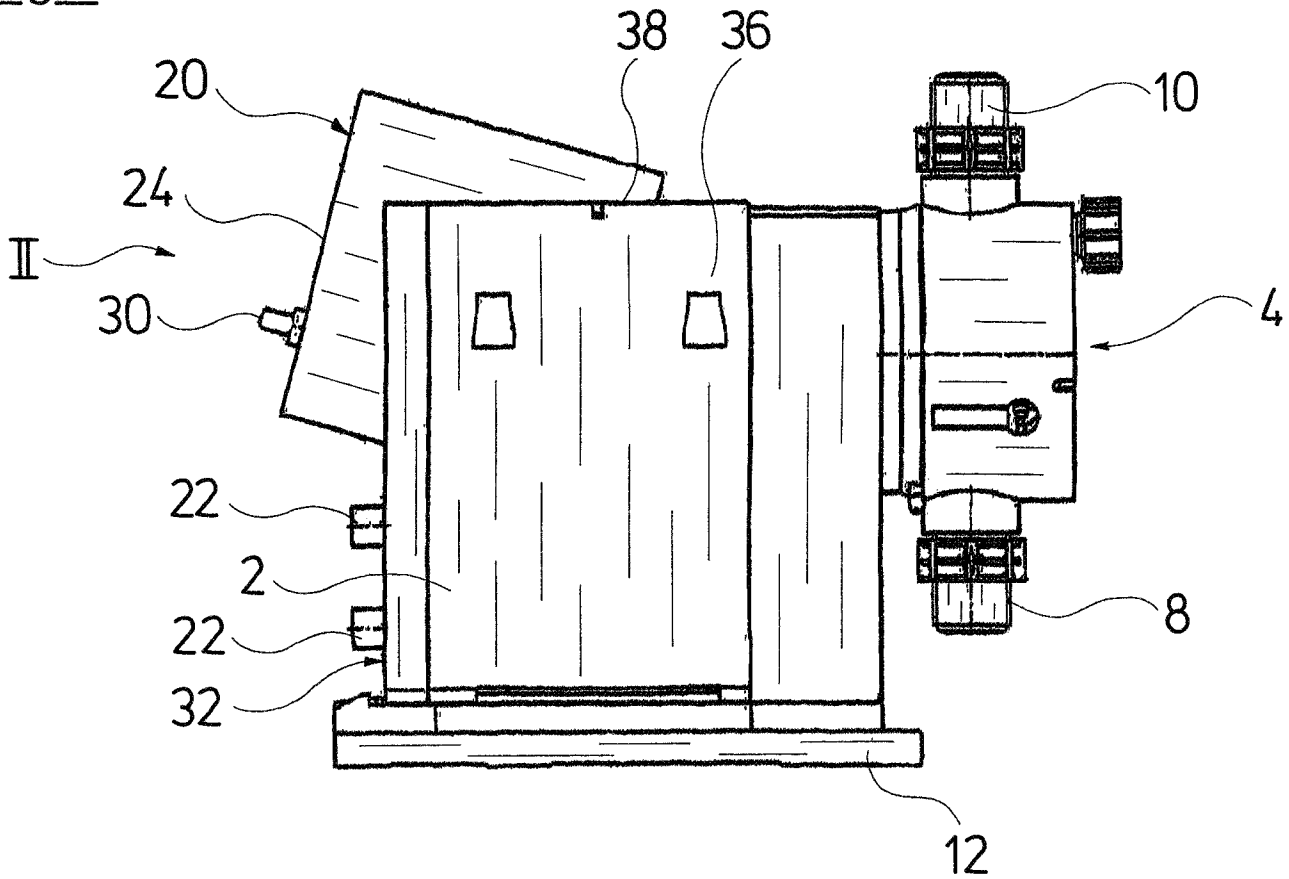
FIG. 1 is a lateral view of a metering pump assembly as an example for a pump assembly according to the invention.

Referring to the drawings in particular, the metering pump assembly shown here comprises a motor housing 2 of an essentially cuboid shape. A pump head 4 is arranged on a first end-side of the motor housing 2 and in its inside comprises a metering chamber 6 as well as a suction connection 8 and a pressure connection 10, is as known from common metering pumps.

The motor housing 2 comprises a foot plate 12, by way of which the metering pump can be set up for example on a support console or can be fastened on a carrier or support in any other suitable manner. An electrical drive motor 14 is arranged in the motor housing 2 and via a gear 16 drives a membrane 15 in the pump head 4. Moreover, control electronics 18 in the form of a suitably equipped circuit board are arranged in the motor housing 2, for the control or regulation of the drive motor 14. The control electronics 18 assume the control or regulation of the drive motor 14 and the entire pump. The drive motor 14 can for example be designed as a stepper motor and be correspondingly activated by the control electronics 18, in order to set the travel speed and the travel length of the travel of the membrane 15 in the pump head 4, in accordance with defined values and, as the case may be, to regulate or control them in dependence on parameters detected via sensors in the pump assembly or also outside the pump assembly. Moreover, an operating unit 20 is provided, in order to be able to provide the control electronics 18 with certain settings and parameters and to be able to issue certain information on the signals determined by the control electronics 18. Moreover, yet electrical connections 22 are provided, via which the control electronics 18 can be connected or linked to external electronic systems for monitoring or controlling the pump assembly.

What is essential to the invention is the arrangement of the operating unit 20 on the motor housing 2. The motor housing 2 forms a first cuboid housing whilst the operating unit 20 is designed as a second housing which is cuboid in its basic shape. The operating unit 20 thereby has a front surface 24, onto which here as a display element, a display 26 as well as operating elements in the form of two push buttons 28 and a rotary button 30 are arranged, of which only the axis is shown in FIG. 1.

Figure 3:
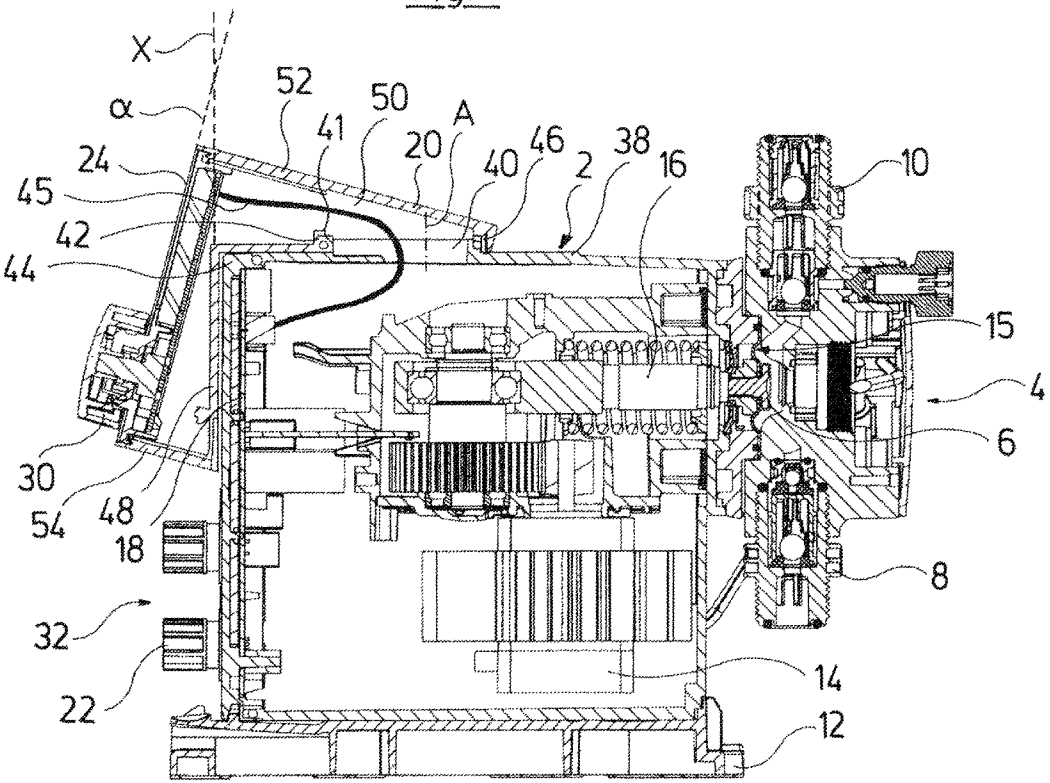
FIG. 3 is a sectioned view of the metering pump assembly in FIG. 1.
Figure 4:
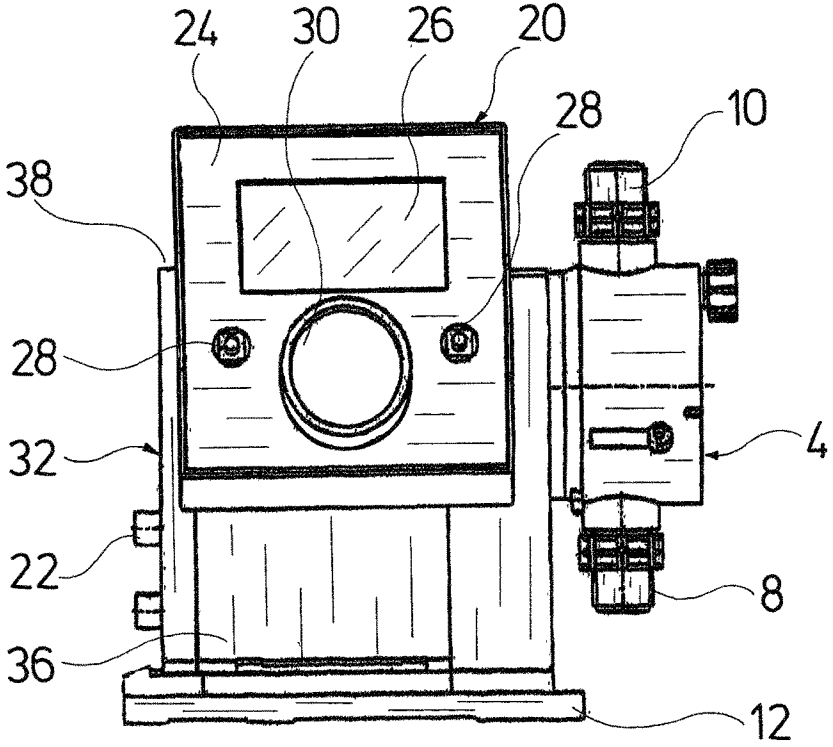
FIG. 4 is a lateral view of the metering pump assembly according to FIG. 1, wherein the operating unit is arranged on another side surface of the metering pump assembly.

The operating unit 20 together with the motor hosing 2 is designed such that the operating unit 20 in the example shown here can be connected to the motor housing 2 in three different positions. Thus the operating unit 20 can either be arranged such that it is situated on rear end-side 32 which is away from the pump head 4, as is shown in the FIGS. 1, 2 and 3. Alternatively, the operating unit 20 can be arranged on one of the two side walls 34 or 36 which are adjacent the end-side 32, wherein the arrangement on the side wall 36 is shown in FIG. 4. Thus the front surface 24 of the operating unit 20 can be arranged selectively in three different spatial directions which are normal to one another, depending on the arrangement, specifically in three positions 0°, 90° and 180° with respect to a vertical axis.

With all three possible poisonings, the operating unit 20 however remains in contact with the upper side 38 of the motor housing 2. A circular opening 40 is formed in the upper side 38 of the motor housing 2, and the wall of the motor housing 2 which forms the upper side 38 projects in a collar-like manner on the periphery of this opening. This collar 41 of the opening 40 engages into a corresponding circular opening 42 on the lower side or on a first contact surface 44 of the operating unit 20. An O-ring seal 46 is arranged in the periphery of the collar 41 of the opening 40 and seals the housing of the operating unit 20 with respect to the motor housing 2 in this region, so that a sealed connection between the housing forming the operating unit 20 and the motor housing 2 is created in the transition between the openings 40 and 22.

Signal leads or cables 45 can be led from the control electronics 18 through the openings 40 and 42 into the inside of the operating unit 20 and to their operating elements and display elements, i.e. to the push buttons 28, the rotary button or dial 30 as well as to the display 26. The middle axis A of the opening 40 in each case is distanced equally to the edge between the upper side 38 and the rear end-side 32 as well as to the edge between the side wall 34 and the upper side 38 and to the edge between the side wall 36 and the upper side 38. This permits the operating unit 20 to be able to be stuck onto the upper side 38 of the motor housing 2 at three different angular positions, specific lay 0°, 90° and 180°, with respect to the middle axis A of the openings 40, wherein in each case the collar 41 of the opening 40 engages into the opening 42 on the first contact surface 44 of the operating unit 20. Thereby, a second contact surface 48 then selectively comes to bear on the rear end-side 32 or one of the side walls 34 and 36. The first and the second contact surface 44 and 48 are designed at an angle of 90° to one another in the example shown here, and in each case form a part of the housing wall of the operating unit 20. The operating unit 20 and the cuboid motor housing 2 with regard to their geometric basic shape form two cuboids which engage into one another, wherein the motor housing 2 with its side edge engages in each case into the right-angled receiver of the operating unit 20 which is formed by the contact surfaces 44 and 48.

Despite the selective arrangement ability of the operating unit 20 on the three lateral walls 32, 34, 36 of the motor housing 2, a cable connection or lead connection 45 between the control electronics 18 and the electrical and electronic components of the operating unit 20 is very simply possible. Such a cable connection or lead connection 45 only permits a certain flexibility or a certain play which allows the operating unit 20 to be lifted upwards from the upper side 38 by a limited amount. Thereby, the operating unit 20 needs only to be lifted and tilted as the case may be, to the extent such that its second contact surface 48 can be moved around the corner between the rear end-wall side 32 and the side wall 34 and/or the corner between the rear end-side 32 and the side wall 36, in order to reapply the operating unit 20 by 90° with respect to the axis A. Subsequently, the operating unit 20 is moved further downwards again and stuck onto the upper side 38, so that the opening 40 comes to bear congruently with the opening 42, or the collar 41 of the opening 40 enters into the opening 42. By way of the bearing contact of the first contact surface 44 on the upper side 38 which forms a first wall of the motor housing 2 and the bearing contact of the second contact surface 48 on the rear end-side 32 or one of the side walls 34, 36 which form a second wall of the motor housing 2, thereby the operating unit 20 is placed on an edge of the motor housing 2 with a positive fit. A displacement of the operating unit 20 along this edge is thus prevented by way of the engagement of the collar 41 into the opening 42. Additionally, the operating unit 20 can be fixed on the upper side 38 by way of screws, wherein the screws which are not shown here can be led through the holes 50 of the operating unit 20.

The front surface 24 in the example shown here is inclined to the vertical X at an angle $\alpha$ of 15°. By way of this, the readability of the display 26 is improved if the pump is viewed obliquely from above. The front surface 24 could however also be inclined at a different angle $\alpha$, in particular between 10° and 70°. The upper side 52 as well as the lower side 54 of the operating unit 20 which extends parallel to this, extend at an angle of 90° to the front surface 24. Inasmuch as this is concerned, the upper side 52 of the operating unit 20 in the assembled condition of the operating unit 20 is likewise inclined by the angle $\alpha$, here 15° to the upper side 38 of the motor housing 2. With regard to the basic shapes, the operating unit 20 forms a cube which engages into the cuboid basic shape of the motor housing 2 or intersects with this.

Figure 2:
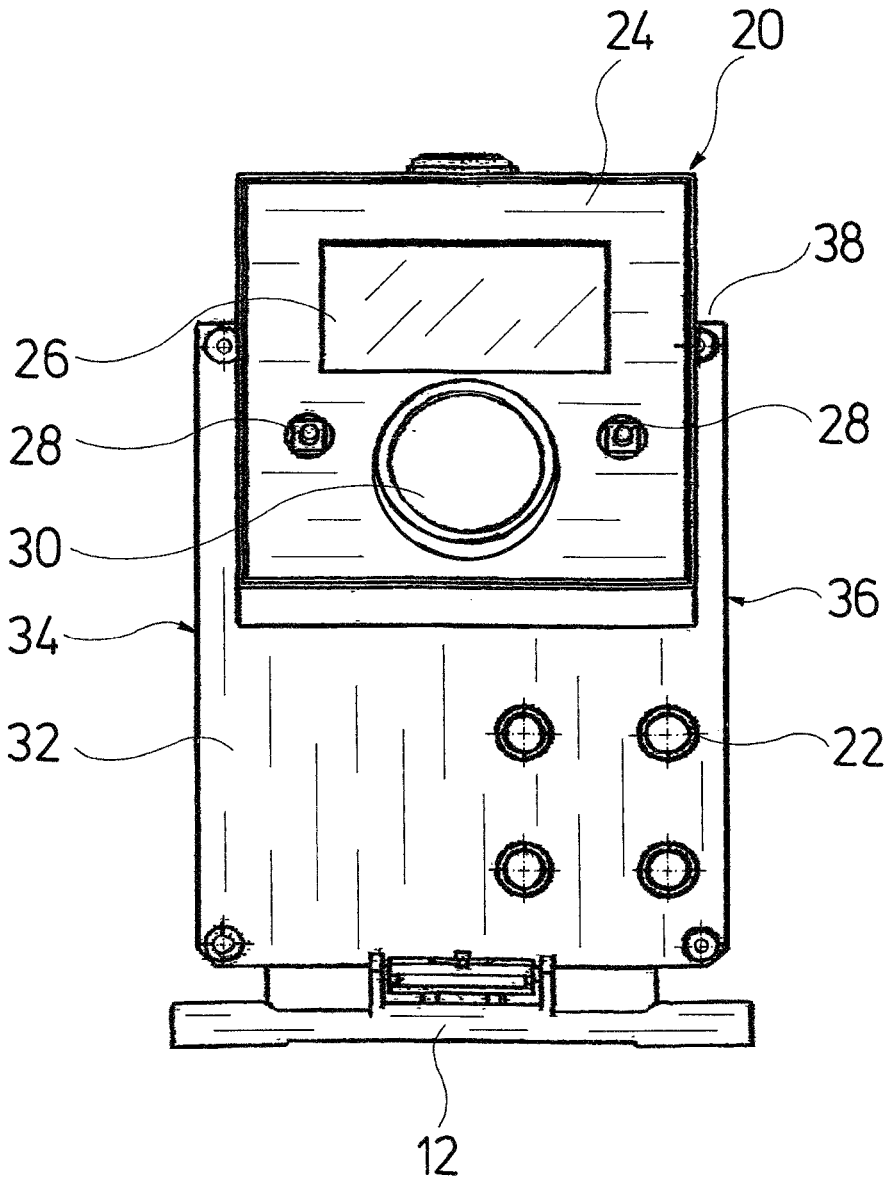
FIG. 2 is a rear view of the metering pump assembly in the direction of the arrow II in FIG. 2.

The arrangement ability of the operating unit 20 in three different positions has the advantage that the front surface 24 of the operating unit 20 can be set up such that it is well accessible and visible, depending on the installation position of the pump. If for example the pump head 4 is aligned to a wall, it is advantageous to arrange the operating unit 20 on the rear end-side 32 as is shown in FIGS. 1 to 3. If the metering pump with the side wall 34 is aligned parallel to a wall, it is however advantageous to arrange the operating unit 20 on the opposite side wall 36, as is shown in FIG. 4.

While specific embodiments of the invention have been shown and described in detail to illustrate the application of the principles of the invention, it will be understood that the invention may be embodied otherwise without departing from such principles.

The invention claimed is:

1. A pump assembly comprising:

a drive motor;

control electronics for the operation of the drive motor;

a housing, in which the control electronics for the operation of the drive motor are arranged, wherein the housing is polyhedral, the housing comprising a top wall and at least two side walls, wherein the housing is a motor housing, in which the drive motor is arranged; and an operating unit with at least one display element and/or operating element, the operating unit being connectable in a positioned manner on at least one of the two side walls and an another one of the two side walls, at least a portion of the operating unit being in contact with the one of the two side walls in one configuration of the operating unit, the at least the portion of the operating unit being in contact with the another one of the two side walls in another configuration of the operating unit, the operating unit being releasably connectable to the housing, the housing comprising the top wall, the operating unit comprising another operating unit portion, the another operating unit portion being in contact with the top wall in the one configuration and the another configuration, wherein the another operating unit portion and the top wall define at least a portion of a connection interface for connecting the operating unit to the housing.

2. A pump assembly comprising:

a drive motor;

control electronics for the operation of the drive motor;

a housing, in which the control electronics for the operation of the drive motor are arranged, wherein the housing is polyhedral, the housing comprising a top wall and at least two side walls, wherein the housing is a motor housing, in which the drive motor is arranged; and an operating unit with at least one display element and/or operating element, the operating unit being connectable in a positioned manner on at least one of said two side walls and an another one of said two side walls, at least a portion of said operating unit being in contact with said one of said two side walls in one configuration of said operating unit, said at least said portion of said operating unit being in contact with said another one of said two side walls in another configuration of said operating unit, wherein the housing comprises a first wall, through which a connection is led to the operating unit, and the operating unit comprises two contact surfaces, including a first operating surface that is in bearing contact with the first wall of the housing, and including a second contact surface that is selectively in bearing contact with at least two walls of the housing which are adjacent the first wall.

3. A pump assembly according to claim 2, wherein the operating unit is operatively connected to the control electronics, said one of said two side walls being located on one side of said top wall, said another one of said two side walls being located on another side of said top wall.

4. A pump assembly according to claim 2, wherein the operating unit is releasably connectable to the housing, the housing comprising said top wall, the operating unit comprising another operating unit portion, said another operating unit portion being in contact with said top wall in said one configuration and said another configuration, wherein said another operating unit portion and said top wall define at least a portion of a connection interface for connecting said operating unit to said housing.

5. A pump assembly according to claim 2, wherein the operating unit is connectable to the housing in at least two positions which are different to the extent that the at least one display element or operating element is directed in different spatial directions which are at right angles to one another, in these positions.

6. A pump assembly according to claim 2, wherein the operating unit is connectable to the housing in a positioned manner on at least two sides of the housing which are directed in different directions.

7. A pump assembly according to claim 2, wherein the housing is cuboid.

8. A pump assembly according to claim 2, wherein the two contact surfaces of the operating unit extend at an angle to one another.

9. A pump assembly according to claim 2, wherein the at least one display element or operating element is arranged on a front surface which extends angled to one of the contact surfaces.

10. A pump assembly according to claim 2, wherein the front surface is angled at an angle $\alpha$ between 5° and 80°.

11. A pump assembly according to claim 2, wherein an opening, through which signal leads are led to the operating unit, is formed in the first wall of the housing.

12. A pump assembly according to claim 11, wherein a middle point of the opening is distanced equally far from the edges of at least two walls which are adjacent the first wall and on which the operating unit is positionable.

13. A pump assembly according to claim 2, further comprising a metering pump assembly or a centrifugal pump assembly.

14. A pump assembly according to claim 2, further comprising:

a pump, wherein the housing is a motor housing, in which the drive motor is arranged and which at one side is connected to the pump, wherein the operating unit is selectively positionable on two sides of the motor housing which are at a spaced location from the pump.

15. A pump assembly according to claim 2, wherein the operating unit is arranged distanced to at least a part of a wall of the housing which is covered by the operating unit.

* * * * *